US008528616B2

(12) United States Patent
Lessig et al.

(10) Patent No.: US 8,528,616 B2
(45) Date of Patent: Sep. 10, 2013

(54) ADHESIVE TAPE APPLICATION DEVICE

(75) Inventors: Dieter Lessig, Kassel (DE); Christoph Böhler, Fürth (DE)

(73) Assignee: Bohler GmbH, Furth (DE)

( * ) Notice: Subject to any disclaimer, the term of this patent is extended or adjusted under 35 U.S.C. 154(b) by 224 days.

(21) Appl. No.: 13/063,650

(22) PCT Filed: Sep. 21, 2008

(86) PCT No.: PCT/EP2008/007959

§ 371 (c)(1), (2), (4) Date: Mar. 11, 2011

(87) PCT Pub. No.: WO2010/031422

PCT Pub. Date: Mar. 25, 2010

(65) Prior Publication Data

US 2011/0186233 A1 Aug. 4, 2011

(51) Int. Cl.
*B65D 85/02* (2006.01)
*B65H 35/07* (2006.01)

(52) U.S. Cl.
USPC ..... 156/526; 156/527; 156/574; 156/577

(58) Field of Classification Search
USPC ..... 156/574, 577, 526, 527
See application file for complete search history.

(56) References Cited

U.S. PATENT DOCUMENTS

| | | | | |
|---|---|---|---|---|
| 3,306,806 | A * | 2/1967 | Seropian | 156/523 |
| 3,930,927 | A | 1/1976 | Thompson et al. | |
| 4,762,586 | A * | 8/1988 | Wilkie | 156/527 |
| 2007/0029048 | A1 * | 2/2007 | Lee | 156/527 |

FOREIGN PATENT DOCUMENTS

| | | |
|---|---|---|
| DE | 1511481 | 7/1969 |
| JP | 53141736 | 12/1978 |
| WO | 2008113548 E | 9/2008 |

* cited by examiner

*Primary Examiner* — Mark A Osele
(74) *Attorney, Agent, or Firm* — Lucas & Mercanti, LLP

(57) ABSTRACT

The invention relates to an adhesive tape application device for applying an adhesive tape section to an object, wherein the adhesive tape application device is designed for pulling an adhesive tape end from a supply of adhesive tape and applying said adhesive tape end to the object as an adhesive tape section by a relative motion of a movable portion and a stationary portion arranged on the object, comprising an application device, wherein the application device is designed and/or arranged for pressing the adhesive tape section against the object in an application position of the application device, wherein the application device is designed and/or arranged for performing a superimposed rotational-linear and/or swivelling-linear movement in the adhesive tape application device.

15 Claims, 16 Drawing Sheets

ADHESIVE TAPE APPLICATION DEVICE

The present application is a 371 of International application PCT/EP2008/007959 filed Sep. 21, 2008, the priority of this application is hereby claimed and this application is incorporated herein by reference.

BACKGROUND OF THE INVENTION

The invention relates to an adhesive tape application device for applying an adhesive tape section to an object, wherein the adhesive tape application device is designed for pulling an adhesive tape end from a supply of adhesive tape and applying said adhesive tape end to the object as an adhesive tape section by a relative motion of a movable portion and a stationary portion arranged on the object.

Adhesive tape application devices are known in the form of adhesive tape dispensers which usually comprise a receptacle for an adhesive tape roll and a blade for severing the adhesive tape. During the operation of such devices, the adhesive tape is taken hold of by the hand in most cases, pulled from the adhesive tape roll to the desired length and severed from the adhesive tape roll by means of the blade. The adhesive tape section thus separated is then applied to an object manually. This procedure is not really convenient; in addition, there is always a risk that the adhesive tape section that has been separated will roll onto itself or stick to itself in another way, thus becoming useless.

In the Japanese document JP53-141736, the figures seem to suggest a hand-operated device which is designed for applying an adhesive tape section to a surface by means of an automated, manual procedure.

The publication DE 1511481 shows a device for dispensing and applying a pressure-sensitive adhesive tape and is most likely the nearest state of the art. Said document discloses a hand-operated device which pulls an adhesive tape end from an endless roll and applies said adhesive tape end to a surface. The device comprises a rotatable stamping element including 4 stamps, wherein the adhesive tape end is perforated by spikes arranged in the stamp surfaces and is pulled from the adhesive tape roll by rotation of the stamping element.

These known devices have a plurality of drawbacks in use, so that a potential object of the invention is to propose modifications of such a device.

SUMMARY OF THE INVENTION

The invention thus relates to an adhesive tape application device and the preferred further developments thereof, as set out in the claims, the specification below and the attached figures.

According to the invention, an adhesive tape application device is disclosed which is suitable and/or designed for applying an adhesive tape section to an object. In particular, the adhesive tape application device may also be referred to as adhesive tape stamp or adhesive tape attachment device. The adhesive tape of the adhesive tape section is preferably designed as a pressure-sensitive adhesive tape which is preferably pulled from the an endless supply, in particular a roll. The adhesive tape can be coated or covered with adhesive on one or both side(s). In particular, the adhesive tape—preferably also to be called carrier—is designed to be free of transfer films and/or liners, i.e. without an additional liner or carrier tape which remains as waste. The adhesive tape section is preferably designed as a film, e.g. made of plastic or paper, and is coated on one or both side(s). Preferably all contact surfaces of the adhesive tape application device which come into contact with the one or both adhesive side(s) of the adhesive tape have adhesion-reducing surfaces, such as surfaces with a low surface energy (Teflon) or with structures (e.g. flutings, roughness, porosity, knobs, grooves, etc.). Particularly preferred, the adhesive tape is designed in such a manner that it can in principle be pulled from the supply to any desired length and/or that its cross-section perpendicular to the longitudinal extent of the adhesive tape is designed to be constant at all times. The object may have any desired design and may preferably be selected at the discretion of the user and may for example be two pieces of paper which are to be stuck together.

The adhesive tape application device can in principle be operated with external energy, but it is preferably designed as a device that is to be operated manually. The adhesive tape application device comprises a movable portion and a stationary portion arranged or placed on the object. During the sequence of motions which is effected by a movement of the movable portion relative to the stationary portion, an adhesive tape end is pulled from the supply of adhesive tape and applied to the object as an adhesive tape section. The adhesive tape section is severed from the supply of adhesive tape before, during or after application of the adhesive tape section to the object.

The adhesive tape application device comprises an application device which is designed and/or arranged for pressing the adhesive tape section against the object in an application position of the application device. Said pressing may optionally be done by stamping and/or rolling and/or pressing. The application device has at least one application surface for pressing the adhesive tape section against the object. In a preferred embodiment, the application device has less than 4 such application surfaces, preferably less than 3 application surfaces and in particular precisely one application surface.

The application device is arranged in the adhesive tape application device in such a manner that it performs a superimposed rotational-linear movement and/or a superimposed swivelling-linear movement. In a potential embodiment, the application device is designed to rotate endlessly, in particular in the case of several subsequent application processes. In another, more preferred embodiment, the application device performs a reversing and/or oscillating sequence of motions; in particular, the application device is first swivelled in a direction of rotation and then swivelled back in the opposite direction. The swivelling angle is preferably selected to be smaller than 360°, in particular smaller than 200°. Particularly preferred, the swivelling angle is calculated about a swivelling axis that extends through the application device.

Particularly preferred, the application device is designed as a stamp plate or stamp body which enables the adhesive tape section to be stamped onto the object in a stamping direction that is parallel or almost parallel to the direction of movement of the movable portion.

Particularly preferred, the last stage of applying and/or pressing the adhesive tape section (on) to the object includes a substantially or completely linear movement of the application device parallel to the direction of movement, wherein the stamp plate or stamp surface is aligned parallel to the underlying surface and/or perpendicular to the direction of movement. In a preferred further development or alternative of the invention, the adhesive tape stamp is dimensioned in such a manner that, in the outermost placement position for placing the adhesive tape section, the stamp surface comprises a projection extending beyond the contact geometry and/or bottom edge of the adhesive tape stamp relative to the object, wherein the projection is designed to be elastic and/or flexible relative to the contact geometry. This elastic projection serves to achieve a uniform contacting pressure of the adhesive tape section even if the underlying surface is irregular. Said elasticity is preferably such that the stamp surface and the contact geometry are flush with an even contact surface during application of the adhesive tape section to an object.

In a particularly preferred embodiment of the invention, the application device comprises a pressing member for pressing and/or placing the adhesive tape end against/on a pressing block. The pressing block may have any desired shape and is defined by a pressing surface against/on which the adhesive tape end is pressed or placed. In particular, the adhesive tape end is positioned on the pressing block with a side that is coated with the adhesive layer.

For the purpose of definition it is stated that the free end of the adhesive tape or of the supply of adhesive tape is referred to as adhesive tape end, which is then severed to become an adhesive tape section, so that a new adhesive tape end is obtained at the severing site.

According to a further development of this embodiment, the application device performs the rotational-linear and/or swivelling-linear movement independently of the adhesive tape end that has been pressed and/or placed against/on the pressing block. Generally speaking, the application device is not connected to the supply of adhesive tape at least at times.

In a particularly preferred embodiment of the invention, the pressing member is supported so as to be movable, in particularly swivellable, in the application device, i.e. it is designed as a component of a swivelling device. This embodiment of the invention enables the adhesive tape end to be actively pressed and/or placed against/on the pressing block.

In a preferred structural configuration of the invention, the pressing member is moved by means of a control device in the stationary portion, which control device is for example designed as a guideway in the form of a curved track and/or a groove. It is preferred that the pressing block be arranged in or fixedly connected to the movable portion.

In an alternative embodiment, the pressing block is designed so as to be movable and/or controlled, so that the pressing block actively acts upon the pressing member with a pressing force and/or pressing movement in order to ensure that the adhesive tape end will be transferred and adhere properly.

In a preferred embodiment of the invention, the application device comprises a clamping device, which in particular is moved along with the application device and is designed for clamping the adhesive tape end, in particular non-destructively. The clamp or clamping device is arranged in the adhesive tape application device in such a manner that the tensile force for pulling the adhesive tape from the supply of adhesive tape is transferred to or introduced into the adhesive tape via the clamp or clamping device. This embodiment in particular eliminates damage to the adhesive tape caused by perforation or the like. In this embodiment, the adhesive tape is preferably pulled from the supply of adhesive tape by means of a rotation and/or swivelling of the application device, wherein the adhesive tape end is fixed to the application device by means of the clamping device, preferably exclusively by the clamping device.

In a preferred structural implementation of the invention, the clamping device comprises a clamping body for clamping the adhesive tape end to the application device, which clamping body is supported so as to be swivellable and/or tillable in a bearing device. The clamping body is preferably designed as a beam that extends across at least half of the width of the adhesive tape. It is preferred, however, that the clamping beam extends across the entire width of the adhesive tape. The adhesive tape end is arranged in the gap between the clamping body and the application device. The clamping body is preferably hinged to the application device on one side only, e.g. by means of an arm, so that the adhesive tape can be passed below the beam or clamping body from the other, open side during an insertion process.

The clamping device is preferably designed in such a manner that the clamping body can have a stable and a metastable position in the bearing device. In the open state, the clamping body is supported so as to be metastable and is preferably pre-tensioned in such a manner that the clamping body is released and automatically moves into the stable, closed position if the angle of the clamping body about its own swivelling axis changes by a few degrees, e.g. in a range from 0° to 3°. In the closed position, the clamping body is pressed onto the application device due to a pre-tension in order to achieve the clamping effect. In a preferred structural realization, the bearing device of the clamping body is realized as a prism bearing, wherein the swivel point is arranged in pointed ends of the clamping body which are arranged on or in the application device.

In an optional further development of the invention, the clamping device comprises an operating handle for manual switching between the two positions. The operating handle is for example designed as an additional flap, in particular a fluted flap.

In a supplementary further development of the invention, the clamping device, in particular the clamping body, and the pressing block comprise areas that engage one another at least temporarily, so that the adhesive tape end can be transferred from the pressing block to the clamping body. In particular, the geometries of the clamping body and the pressing block are designed in such a manner that they will temporarily overlap and/or engage one another by means of teeth while holding the tape end. In this way, the transfer of the adhesive tape from the pressing block to the clamping body and hence to the application device is designed in an operationally reliable manner.

In a further development of the invention, the application device comprises a first cutting device and the stationary portion comprises a second cutting device, wherein the first and second cutting devices are designed to jointly severe the adhesive tape section from the adhesive tape roll. To effect the severing process, joint action of the first and second cutting devices is required. Severing is preferably done by shearing, wherein the adhesive tape is held in a position perpendicular to the cutting devices in the severing zone in order to prevent the tape from being squeezed between the cutting devices.

With the aim of increasing the operational reliability even further, it is preferred that the first and/or the second cutting device(s) is/are suspended and/or supported so as to be resilient and/or elastic perpendicular to the direction of cutting. This provides the advantage that the correct cutting positions of the cutting devices will be achieved in an automated manner. In particular, the cutting devices are arranged at an oblique angle to each other in such a manner that the adhesive tape will be severed by shearing, wherein said shearing initially starts from a first point on the adhesive tape and then continues all through the adhesive tape.

Particularly preferred, the second cutting device is offset relative to the first cutting device towards the centre of the application device in the cutting position. By positioning the second cutting device between the first cutting device and an adjacent plate edge of the application device in the cutting position, the adhesive tape is perfectly prepared for severing.

This structural configuration thus also serves to increase the operational reliability of the adhesive tape application device.

With the aim of preventing malfunction or the like of the adhesive tape application device in the case that the process of applying the adhesive tape is not completed, an anti-retraction feature is preferably integrated between the stationary and the movable portions and prevents the movable portion from being retracted until the adhesive tape section has been applied to the object and/or until the bottom dead centre has been reached and/or until the pressing movement has been completed. This anti-retraction feature is for example a track to be travelled along comprising a first path, a return path and two connecting transition points, wherein the first path is designed with a catch mechanism which retains the movable portion in its current position in the case of a premature release before the bottom transition and/or turning point has been reached.

A preferred embodiment of the adhesive tape application device thus relates to an embodiment where the application device operates in an oscillating and/or reversing manner and the application device comprises a clamping device, a pressing member, a stamp surface and a cutting device as functional components.

In a preferred embodiment, the movable portion is connected to and/or covered by a lid, which serves as an operating part at the same time. Preferably, the lid completely covers the stationary portion, thus eliminating a risk of injury caused by trapping during operation of the adhesive tape application device. It is preferred that the lid be designed so as to be removable and/or separable from the body of the adhesive tape application device in order to replace the supply of adhesive tape.

The movable portion preferably comprises a swivel joint which is designed to swing out a sub-portion of the movable portion including the roll and optionally also the application device in order to facilitate the replacement of the supply of adhesive tape, in particular of the adhesive tape roll.

For returning the movable portion from the pressing position of the application device, an elastic device, in particular a helical spring, is preferably provided, which is tensioned during manual operation of the adhesive tape application device and returns the movable portion to its starting position due to the stored energy In particular, the elastic device is designed in such a manner that it has a certain pre-tension in its normal position of rest which is enough to push out the movable portion sufficiently by means of spring force if the lid is open, so that the sub-portion of the movable portion can be swung out.

BRIEF DESCRIPTION OF THE DRAWING

Further distinguishing features, advantages and effects of the invention will be apparent from the following description of a preferred exemplary embodiment of the invention. In the figures.

DETAILED DESCRIPTION OF THE INVENTION

Figure 2:
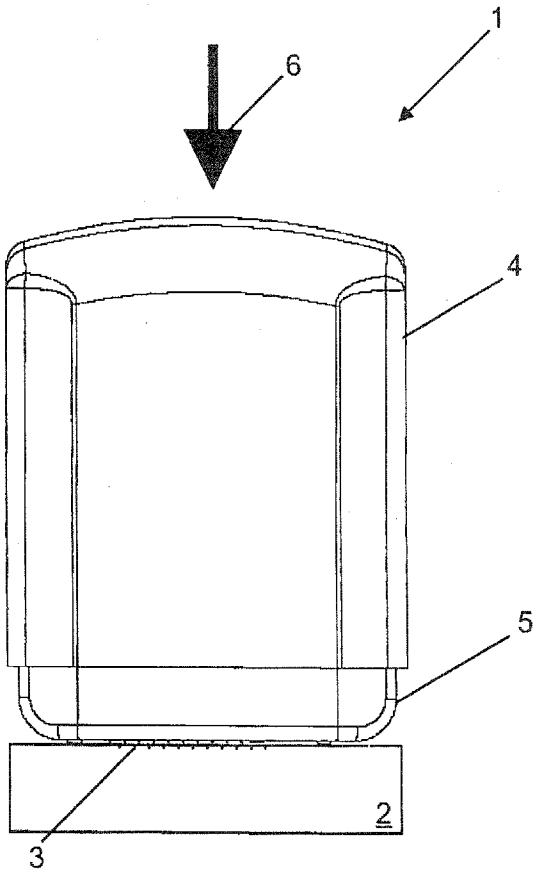
FIGS. 1, 2 show side views of an adhesive tape stamp in the position of rest and in the position of pulling off the tape as an exemplary embodiment of the invention.

Similar or identical parts are marked with identical reference numerals in the figures.

Figure 1:
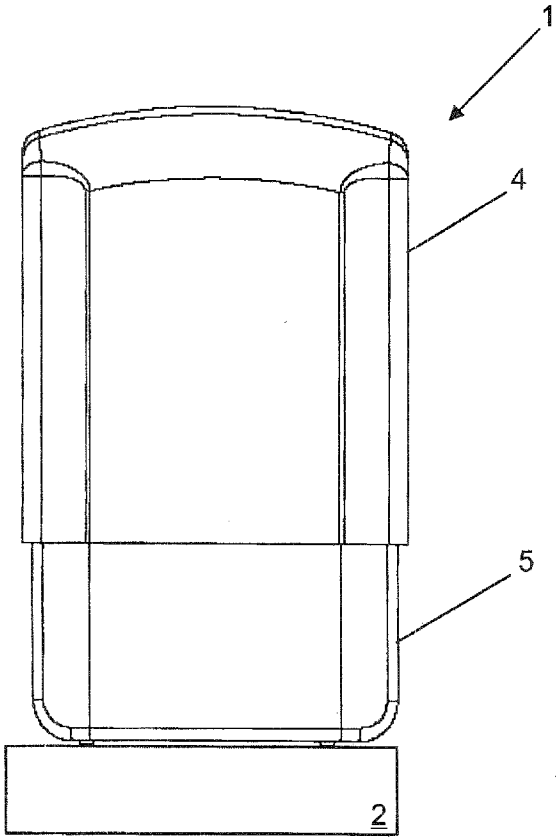

FIG. 1 shows a front elevation of an adhesive tape stamp 1 as an exemplary embodiment of an adhesive tape application device according to the invention. The adhesive tape stamp 1 is placed on an object 2 which is to be provided with an adhesive tape section 3 (FIG. 2).

The adhesive tape stamp 1 of FIG. 1 is in the position of rest and comprises an upper housing part 4 which can be enclosed by a hand (not shown) and operated during operation of the adhesive tape stamp 1. If the adhesive tape stamp 1 is actuated, the upper housing part 4 is moved relative to a lower housing part 5 which is arranged so as to be stationary on the object 2. The stamping direction or direction of movement is shown by an arrow 6 in FIG. 2.

The upper housing part 4 is designed with an approximately rectangular cross-section perpendicular to the direction of movement 6 and encloses and/or surrounds the lower housing part 5 whose cross-sectional dimension is somewhat smaller, so that the actuation of the adhesive tape stamp 1 does not involve a risk of injury to the user. The arrangement of the upper housing part 4 and the lower housing part 5 may also be referred to as upside-down arrangement.

If the adhesive tape stamp 1 is actuated, the adhesive tape section 3, which is shown by dotted lines in FIG. 2, is pressed onto the object 2. The adhesive tape section 3 extends approximately perpendicular to the direction of movement 6. FIG. 2, however, shows the adhesive tape stamp 1 shortly before placement of the adhesive tape section 3, which is why the latter is shown by dotted lines.

Figure 3:
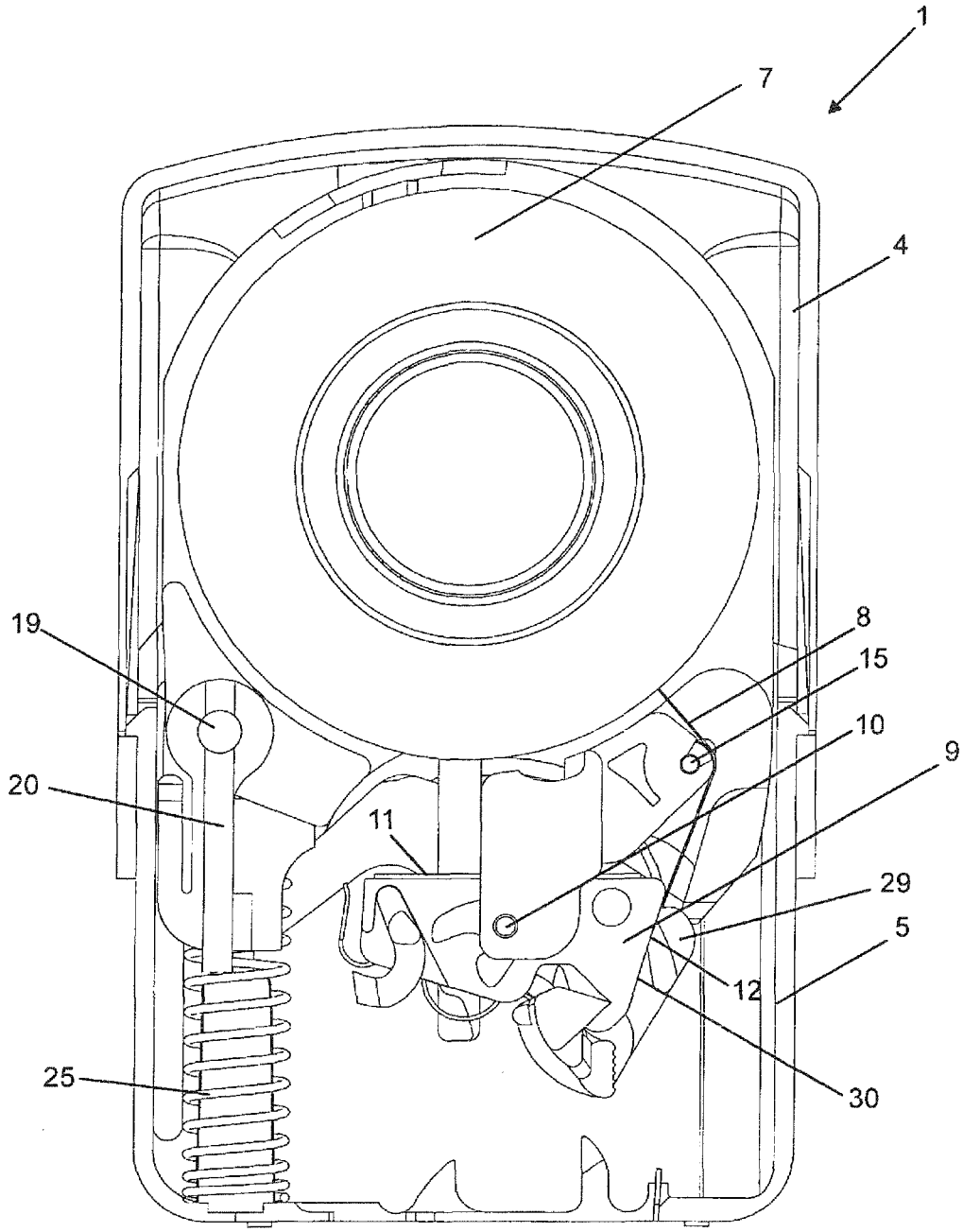
FIGS. 3, 4 show partially sectional views of the adhesive tape stamp of the previous figures from the other side.
Figure 4:
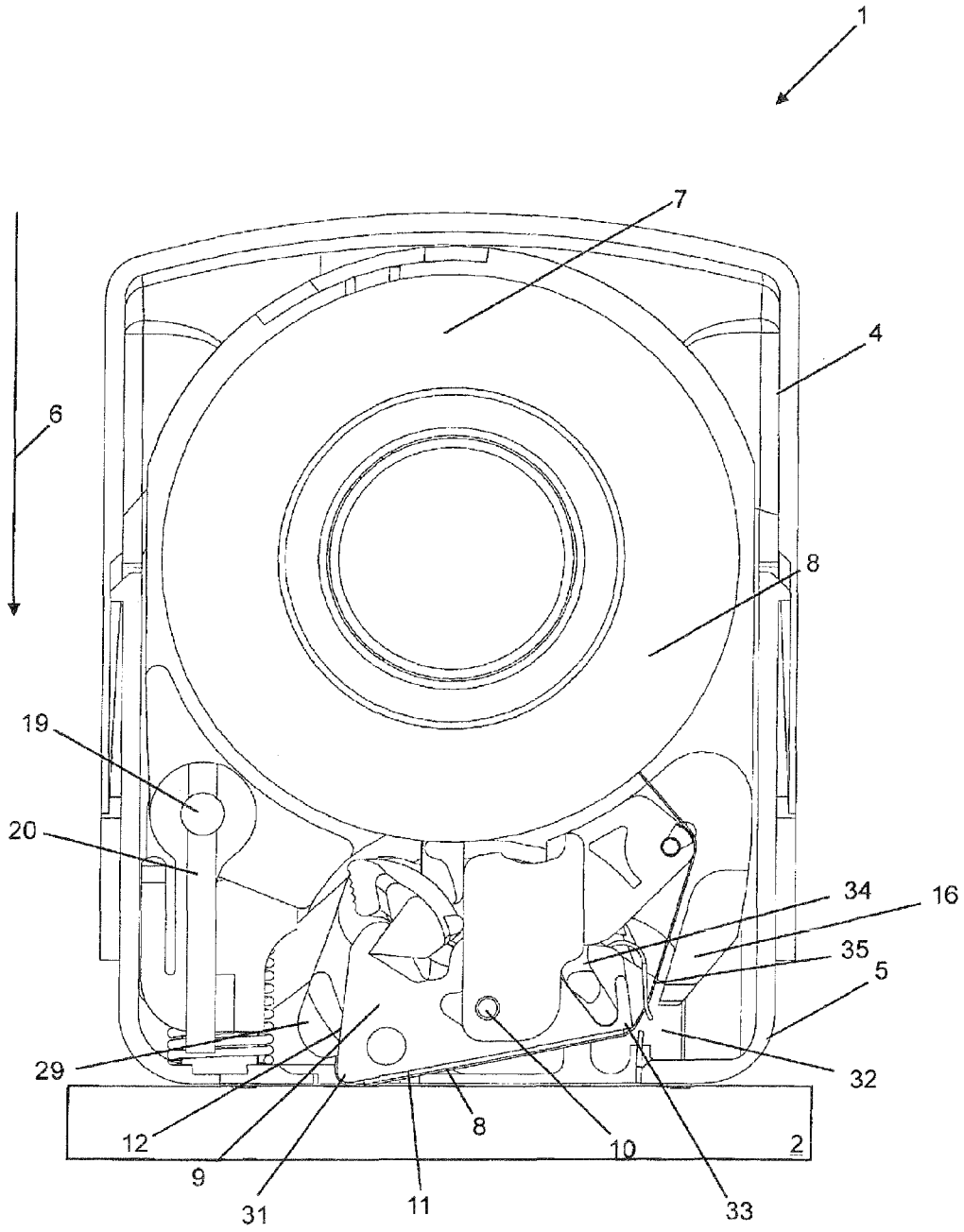

FIGS. 3 and 4 show the adhesive tape stamp 1 in the same state as in FIGS. 1 and 2, but from the other side as an opened or partially sectional view.

In the area of the upper housing part 4, an adhesive tape roll 7 is supported so as to be rotatable, from which adhesive tape roll an adhesive tape 8 can be pulled. The adhesive tape 8 is designed as a so-called pressure-sensitive adhesive tape and is coated with an adhesive on one side in this example.

Roughly speaking, the adhesive tape 8 extends from the adhesive tape roll 7 to a plate body 9—also referred to as plate housing—where it is clamped in the position of rest of the adhesive tape stamp 1 shown in FIG. 3.

When changing from the position of rest in FIG. 3 to the position of pulling off the tape in FIG. 4, the plate body 9 is displaced in a straight line in the stamping direction 6 and is at the same time swivelled by almost 180° about a plate axis 10 arranged in the plate body 9. Said swivelling serves to tension the adhesive tape 8 across a stamp surface 11 arranged on the plate body 9, and said adhesive tape is then placed on the object 2—initially in the area of the clamped adhesive tape end—and is rolled or stamped onto the object 2 and pressed against said object as the swivelling by 180° is completed.

As will be explained below, the adhesive tape 8 is severed in a suitable place, so that the adhesive tape section 3 will be separated from the adhesive tape 8 and pressed onto the object 2 as a result of the sequence of motions.

To explain the precise mode of functioning of the adhesive tape stamp 1, illustrations will hereinafter be used where areas or parts of the adhesive tape stamp 1 are suppressed in the drawings.

Figure 5:
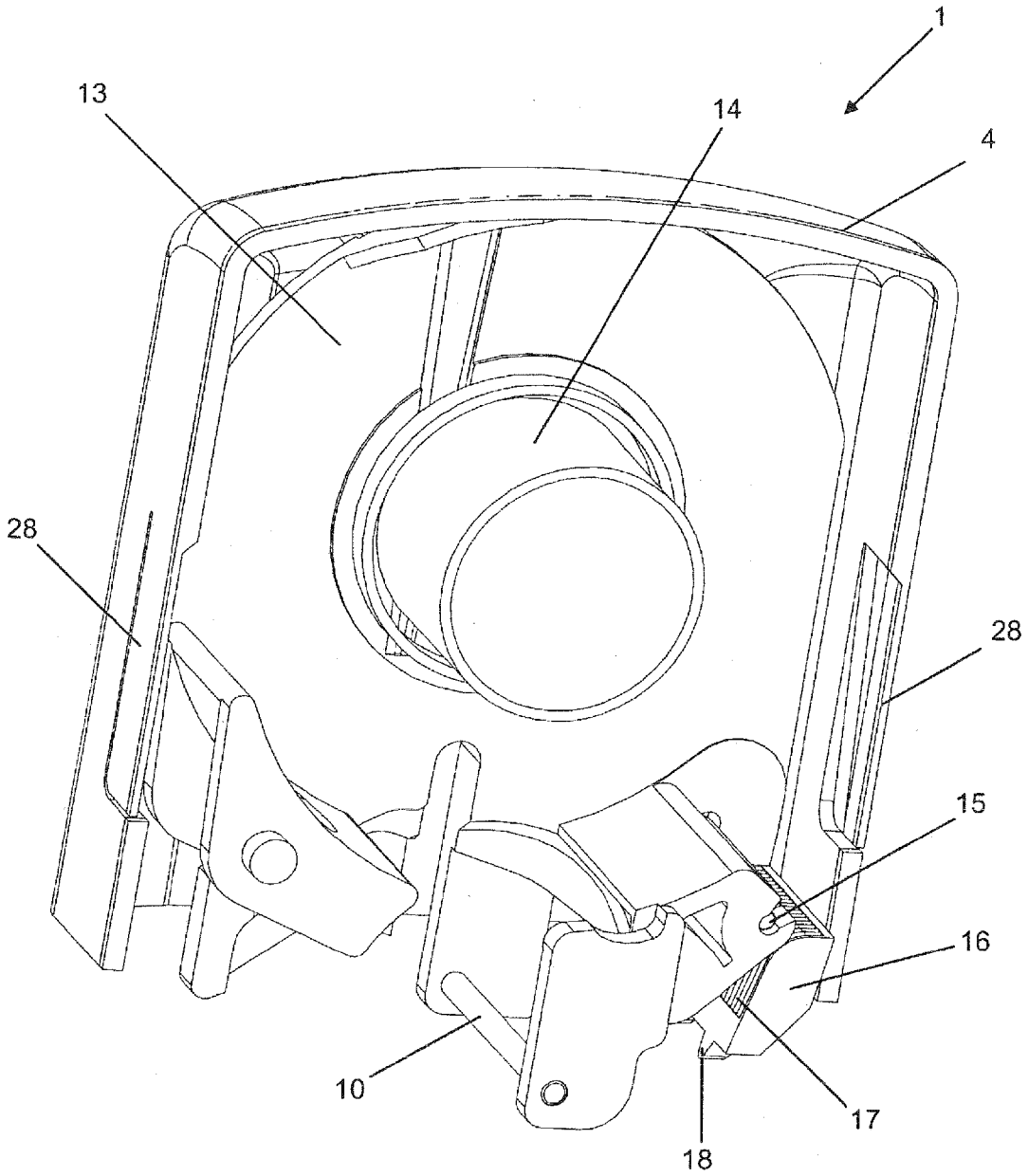
FIG. 5 shows a diagrammatic, three-dimensional view of the pusher of the adhesive tape stamp including the upper housing part of the previous figures.

For example, FIG. 5 is a diagrammatic, three-dimensional view of the opened adhesive tape stamp 1 which shows only the upper area including the upper housing part 4 where a pusher 13 is arranged. If the adhesive tape stamp 1 is actuated, the pusher 13 is displaced in the stamping direction 6 jointly with the upper housing part 4. Said pusher comprises a roll holder 14 for holding the adhesive tape roll 7, carries a tape deflection roller 15 for deflecting the adhesive tape 8, and the plate axis 10 about which the plate body 9 is swivelled during actuation. The tape deflection roller preferably has an adhesion-reducing surface for the use of adhesive tape coated on both sides. The upper housing part 4, the pusher 13, the plate axis 10 and hence the plate body 9 carry out the same linear motion during actuation, wherein the plate body 9 is swivelled forward and back during said linear motion.

Further functional elements carried by the pusher 13 include a delivery block 16—also referred to as pressing block—having a fluted surface 17 for placing the adhesive tape 8 so that it will adhere thereto and a toothed holding contour 18 on the side of said block, whose function will be explained later on. On the opposite side, a cylinder-shaped pin is integrally moulded in the pusher 13 on both sides as a swivel joint axis 19. As can be seen in FIGS. 3 and 4, a swivel joint body 20 is mounted so as to be swivellable about the swivel joint axis 19.

Figure 6:
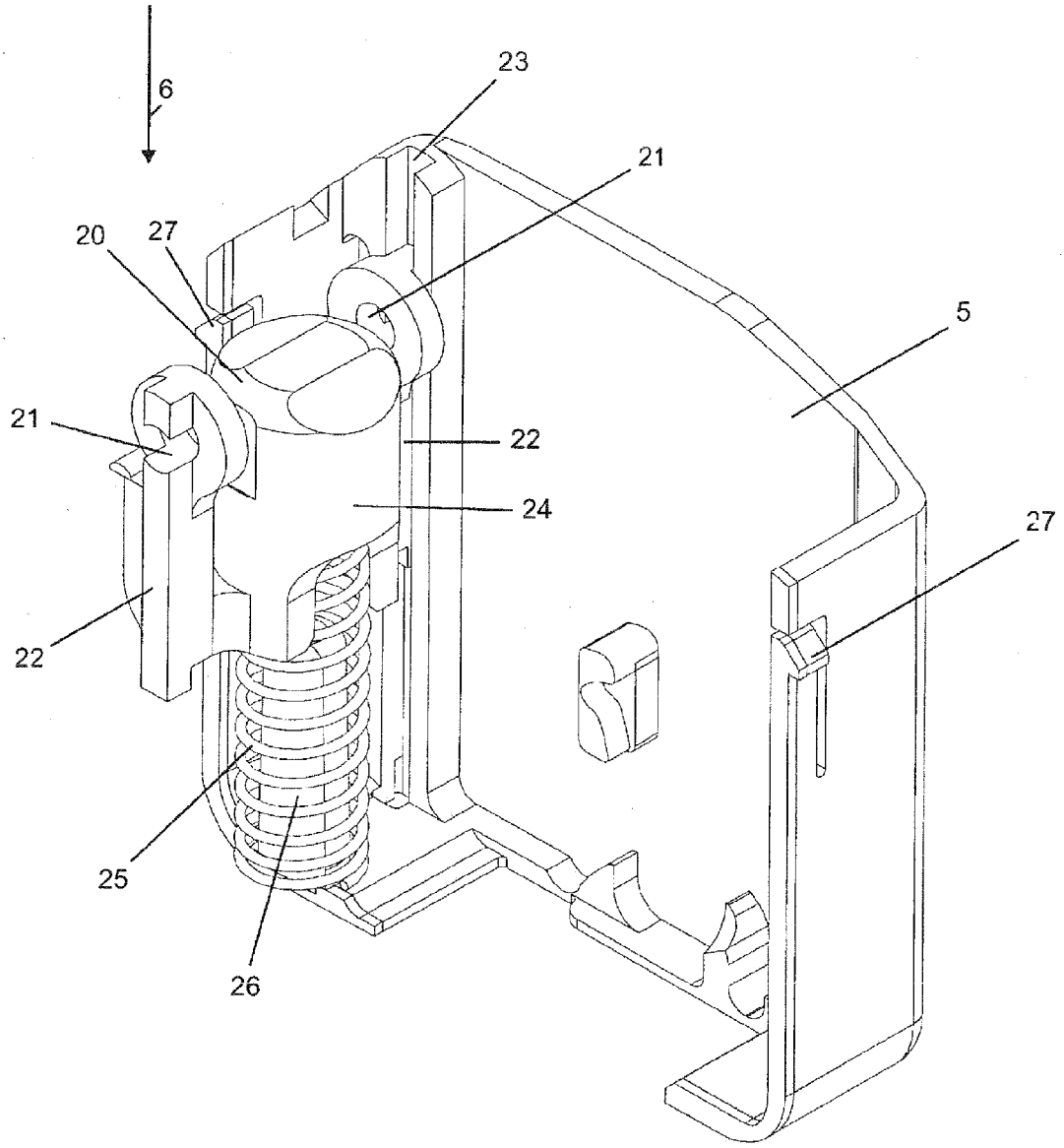
FIG. 6 shows a diagrammatic, three-dimensional view of the lower housing part of the adhesive tape stamp of the previous figures.

FIG. 6 shows the lower housing part 5 of the adhesive tape stamp 1 jointly with the swivel joint body 20 that is constructed in one part. As can be seen in this illustration, the swivel joint body 20 has two receptacles 21 for the cylinder-shaped pins of the swivel joint axis 19 (not shown). Guiding rails 22 extend from the swivel joint body 20 in the direction of movement 6, which rails are positively guided in complementary guideways 23 in the lower housing part 5, so that the swivel joint body 20 will be guided in a straight line in the lower housing part 5.

In the central section of the swivel joint body 20, a spring receptacle 24 is provided, which is downwardly open in the direction of movement 6 and holds a helical spring 25 which bears against the lower housing part 5. To guide the spring 25 and optionally as an end stop of the adhesive tape stamp 1, a peg 26 is integrally moulded on the lower housing part 5, on which peg the helical spring 25 is placed. The helical spring 25 accomplishes the task of generating a counteracting force during actuation of the adhesive tape stamp 1 and of automatically returning the upper housing part 4 including the pusher 13 to the starting position due to a stored spring energy once the adhesive tape section 3 has been pressed onto the object 2.

FIG. 6 also shows two catches 27 for locking the housing, which catches are integrally moulded on the lower housing part 5, comprise outwardly facing noses and serve to lock the upper housing part 4. When the upper housing part 4 is returned due to the spring force of the helical spring 25, the upper housing part 4 is displaced opposite to the direction of movement 6 until the catches 27 will engage matching projections of the upper housing part 4.

As can especially be seen in FIG. 5, the upper housing part 4 comprises unlocking elements 28 which correspond to the catches 27 and are designed as Haps that are integrally moulded on one side and can be actuated to disengage the catches 27, so that the upper housing part 4 can be slid off the lower housing part 5.

Following the description of the main components of the adhesive tape stamp 1, the sequence of motions of the adhesive tape stamp 1 will now be described, starting from the position of rest shown in FIG. 3:

Returning to FIG. 3, this figure shows the plate body 9 comprising a stamp surface 11 which faces in a direction opposite to the direction of movement 6. The adhesive tape 8 is deflected around the tape deflection roller 15 and clamped to a front side 30 of the plate body 9 by means of a clamping beam 29. The clamping beam 29 and/or the front side 30 is/are preferably provided with an adhesion-reducing surface on its/their surface contacting the adhesive tape 8, in particular if adhesive tape coated on both sides is used. The position of rest is the starting position for operation, wherein the pusher 13 is at an upper dead centre.

The helical spring 25 has a residual tension in order to displace the pusher 13 upwardly for replacement of the adhesive tape roll 7 and tilting about swivel joint axis 19 once the upper housing part 4 has been removed and unlocked. The upper housing part 4 is delimited and held in position relative to the lower housing part 5 by means of the catches 27. The free adhesive tape end 12 is arranged so as to be free or substantially free relative to the delivery block 16.

If the adhesive tape stamp 1 is actuated in the direction of movement 6, the plate body 9 is caused to swivel about the plate axis 10, wherein adhesive tape 8 is pulled from the adhesive tape roll 7. To increase the operational reliability, the adhesive tape 8 is deflected in a defined manner around the tape deflection roller 15. The clamping beam 29 clamps the adhesive tape end 12 to the front side 30 of the plate body 9.

FIG. 4 shows the adhesive tape stamp 1 while the adhesive tape 8 is pressed onto the object 2, wherein the adhesive tape 8 is already placed on the object 2 in the area of a plate edge 31 of the plate body 9 in the area of the adhesive tape end 12.

After or during placement, the clamping beam 29 is detached from the front side 30, so that the clamped adhesive tape end 12 is released. The plate angle of the stamp surface 11 to the surface of the object 2 is 11° in the embodiment shown, wherein a range of 0°-20° may be useful in alternative embodiments.

As the upper housing part 4 is continued to be moved in the direction of movement 6, the plate body 9 completes the swivelling by 180°, wherein the following actions are performed at the same time or almost at the same time:

The clamping beam 29 is opened further and completely releases the clamped adhesive tape end 12. A cutting device 32, which will be explained in more detail later on, severs the adhesive tape 8 by shearing in the area of the opposite plate edge 33. A pressing member 34 pushes the newly formed tape end 35 in the direction of the delivery block 16 and places or sticks the new tape end 35 on(to) the delivery block 16. The pressing member 34 is preferably provided with an adhesion-reducing surface on its surface contacting the adhesive tape 8, in particular if adhesive tape coated on both sides is used.

Figure 7:
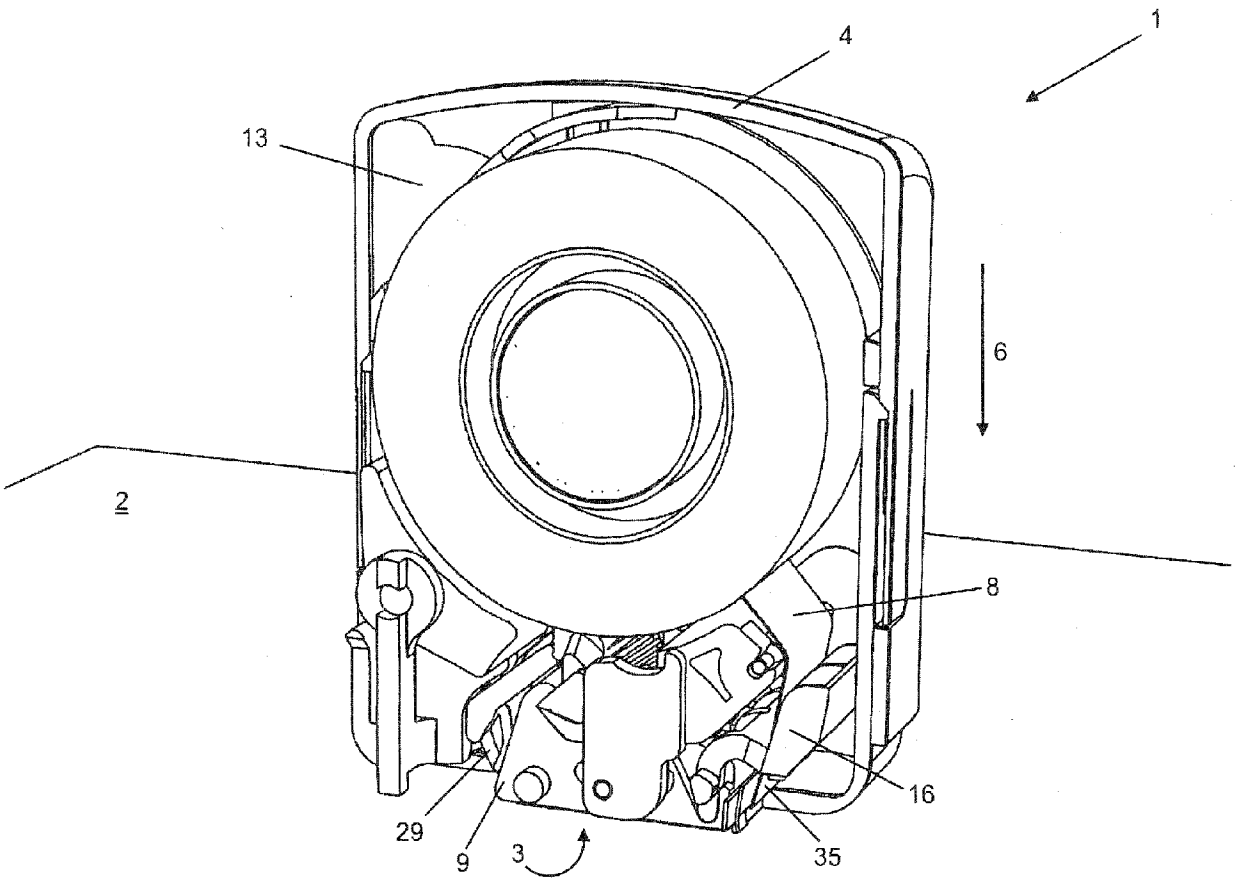
FIG. 7 shows a partially sectional view of the adhesive tape stamp of the previous figures.

In the state of the adhesive tape stamp shown in FIG. 7, the adhesive tape section 3 has been pressed against the object 2 and released. The stamp surface 11 for pressing the adhesive tape section 3 against the object 2 is preferably provided with an elastic and/or flexible covering in order to distribute the pressure during pressing.

Once the adhesive tape section 3 has been successfully placed, stamped and/or pressed on(to) the object 2, the user reduces his/her actuating force and the pusher 13 is displaced opposite to the actuating direction 6 and jointly with the upper housing part 4 by the spring force of the helical spring 25. Meanwhile, the clamping beam 29 is open to release the adhesive tape section 3. The new free tape end 35 is supported on the delivery block 16, so that the plate body 9 is disconnected from the adhesive tape 8 in this state.

During the backward or upward movement, the plate body 9 swivels back in the opposite direction, thus swivelling by 0-180° in the opposite direction, i.e. from 180° to 0°.

Figure 8:
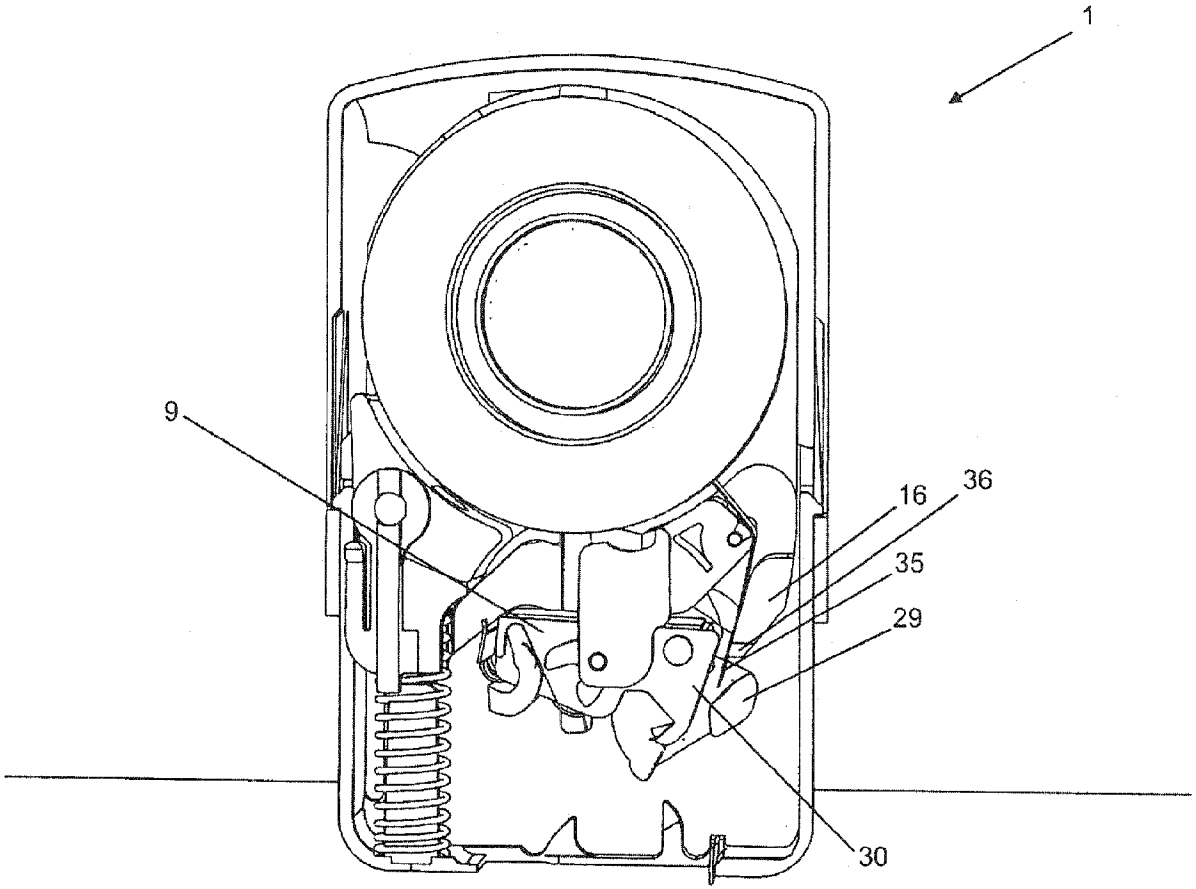
FIG. 8 shows a partially sectional view of the adhesive tape stamp of the previous figures shortly before the position of rest.

FIG. 8 shows the adhesive tape stamp 1 shortly before it returns to the position of rest according to FIG. 3, wherein the plate body 9 has swivelled back almost completely. In this state, the clamping beam 29 is completely open and the new adhesive tape end 35 adheres to the delivery block 16. The new adhesive tape end 35 projects beyond the delivery block and extends into an area between the clamping beam 29 and the front side 30 of the plate body 9. Next, the new tape end 35 is seized by the clamping beam 29 by means of a snapping movement of the clamping beam 29 and clamped to the front side 30 of the plate body 9. At the same time, the new adhesive tape end 35 is pulled from the delivery block 16. To ensure that the new adhesive tape end 35 is transferred from the delivery block 16 to the clamping beam 29 in an operationally reliable manner, an end portion which faces the clamping beam 29 in this position as well as the edge of the clamping beam 29 facing said end portion 36 are provided with engaging contours, in this case teeth, so that they will overlap while holding the adhesive tape end. Once the new adhesive tape end 35 has been seized, the adhesive tape stamp 1 returns to its position of rest according to FIG. 3.

Figure 9:
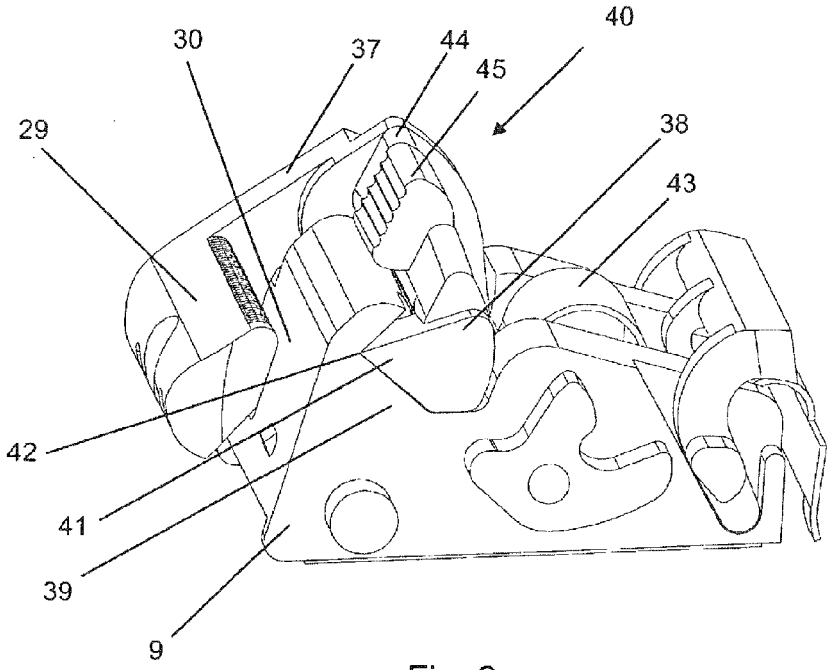
FIGS. 9-12 each show a diagrammatic, three-dimensional view of the plate body of the adhesive tape stamp in different operating states.
Figure 10:
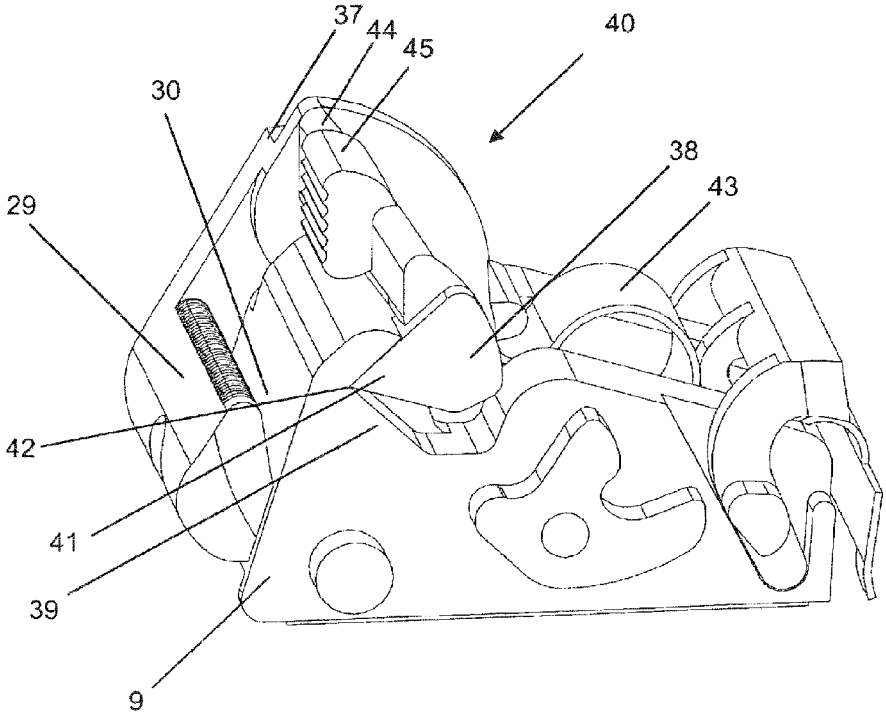

FIGS. 9 and 10 each show a diagrammatic, three-dimensional view of the plate body 9, wherein the clamping beam 29 is arranged at a distance from the front side 30 of the plate body 9, i.e. there is no clamping action, in FIG. 9. In contrast, the clamping beam 29 shown in FIG. 10 bears against the front side 30 in a clamping manner.

The clamping beam 29 is attached on one side and by one part by means of a clamping arm 37, so that the gap between the clamping beam 29 and the front side 30 is freely accessible from the opposite side. In this way, an adhesive tape 8 can easily be inserted.

A bearing portion 38 is also connected to the clamping beam 29 and the clamping arm 37 by one part, which bearing portion is supported in a bearing cup arrangement 39 of the plate body 9 by means of a prism bearing 40. For this purpose, either side of the bearing portion comprises a prism end 41 having a tip and two edges extending from said tip, wherein the clamping beam 29 is supported so as to be swivellable on the tips of the prism ends 41 with very low friction. The edges of the prism end 41 each define an end stop in the bearing cup arrangement 39.

A spring element 43 in the form of a pre-tensioned leaf spring pushes the movable part of the prism bearing 40 against the bearing cup arrangement 39 in the plate body 9. The spring element 43 pre-tensions the clamping beam 29 in such a manner that the latter can have two stationary positions, wherein the prism bearing 40 is designed to be asymmetrically bistable.

The open position of the clamping beam 29 shown in FIG. 9 is metastable, so that a small swivelling movement about the tips 42 is sufficient for the clamping beam 29 to snap into place. In contrast, the position of the clamping beam 29 shown in FIG. 10 is stable, wherein the clamping beam 29 is actively pressed onto the front side 30 by the spring element 43.

To facilitate manual insertion of the adhesive tape 8, the prism bearing 40 comprises an actuating beam 44 which is arranged parallel to the clamping beam 29 and comprises an actuating portion 45. If the actuating portion 45 is pressed, the prism bearing 40 can be caused to change from the position shown in FIG. 10 to the metastable position of FIG. 9. The prism bearing 40 is controlled as a result of the interaction of the control pins on the side of the plate body and the clamping beam respectively with control devices arranged in the lower housing part 5 and/or the pusher 13 which include control elements and/or control surfaces, in particular control grooves. The clamping beam 29 is tensioned for example by pressure applied to a control pin by a control surface of the pusher 13. The spring element 43 is inserted so as to be pre-tensioned and produces the pressing force.

Figure 11:
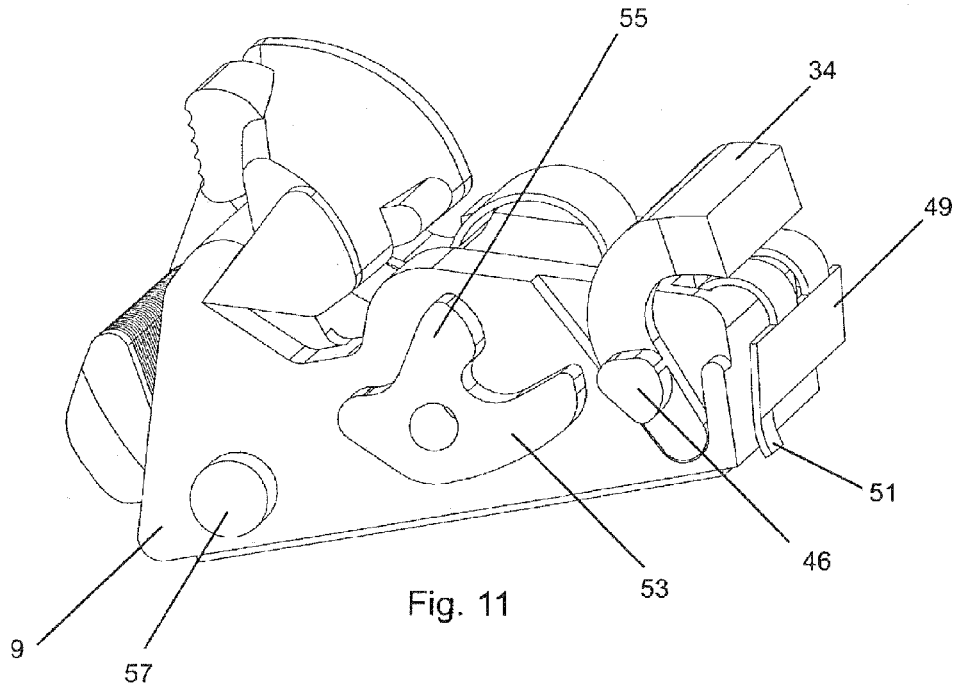
Figure 12:
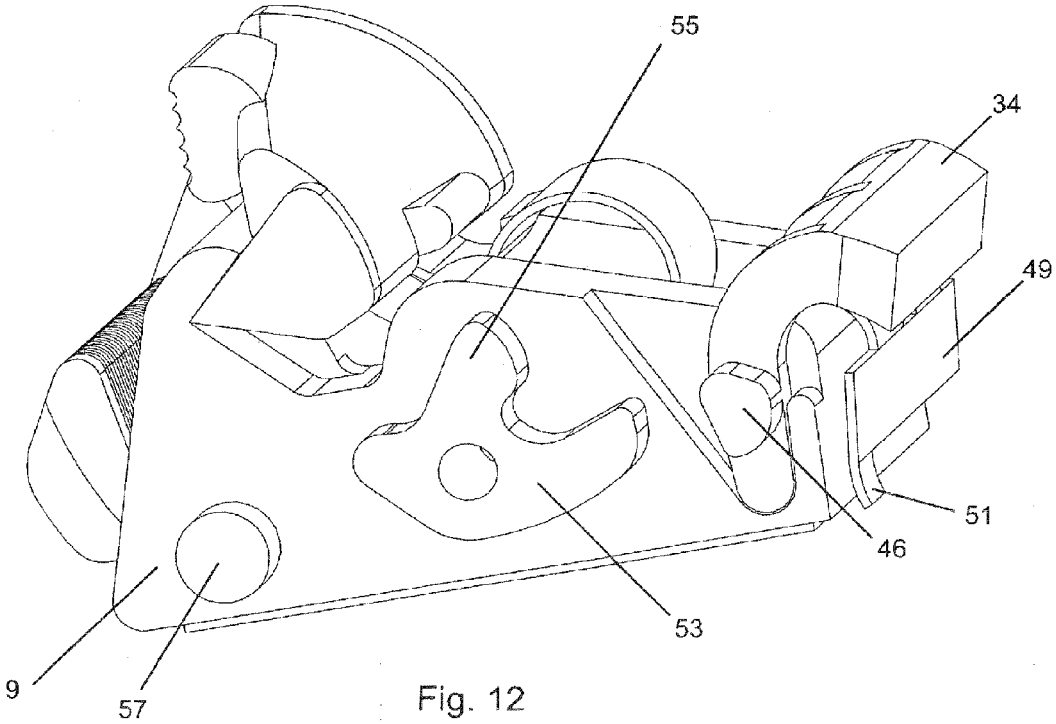

FIGS. 11 and 12 are diagrammatic, three-dimensional views of the plate body 9 as well, wherein the main focus is on the pressing member 34 here. The pressing member 34 is also designed like a beam and is supported so as to be swivellable in the plate body 9. FIG. 11 shows the pressing member 34 in a swivelled-back position and FIG. 12 shows a pressing position. As an alternative to the swivelling configuration shown, the free tape end 35 may be pressed against the delivery block 16, which is on the side of the pusher, by rotatable and/or linearly movable and/or resilient pressing members on the side of the plate body, so that it will adhere to the delivery block in a sufficiently accurate position and a stable manner. The control of the pressing member 34 is transmitted to one or two control cams 46 of the pressing member 34 by means of a control curve on the side of the housing.

The plate body 9 thus integrates a plurality of functions and is an actor in the adhesive tape stamp 1. The pressure caused by the actuating movement is translated into a swivelling movement by means of the plate body 9. The device is driven by means of a modified gear wheel segment 53 for the swivelling movement and a pin-in-groove guide mechanism for the placement stage. The plate body 9 forms a structure or housing and accommodates the other mechanical functional elements shown.

Figure 13:
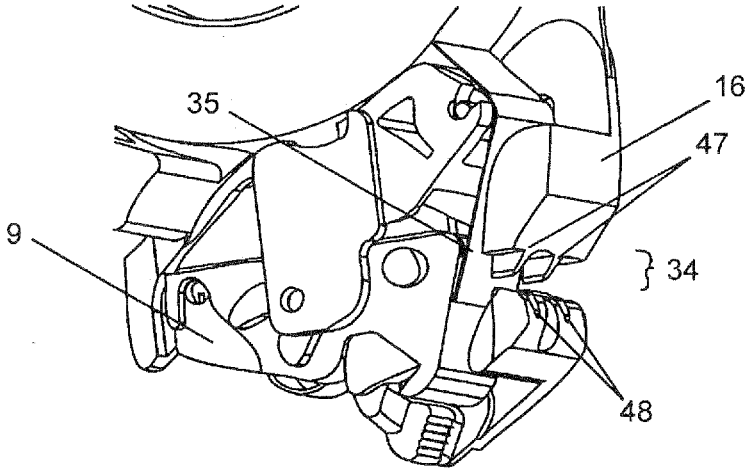
FIGS. 13, 14 show detailed views of the adhesive tape stamp in order to illustrate the tape transfer.
Figure 14:
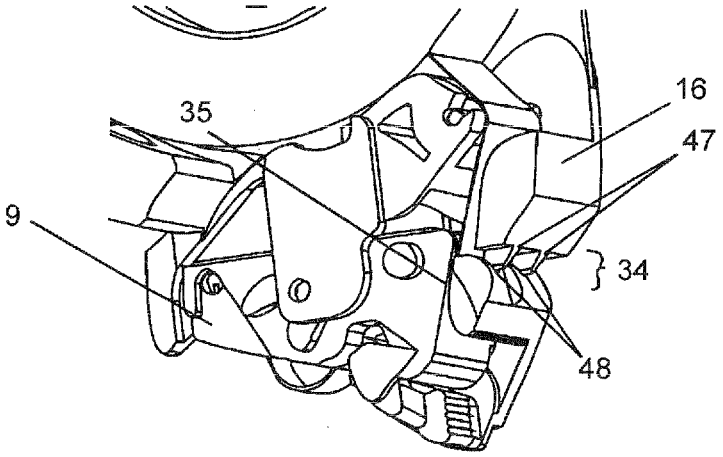

FIGS. 13 and 14 illustrate the transfer of the free adhesive tape 35 shortly before the adhesive tape stamp 1 returns to its position of rest. The delivery block 16 comprises two teeth 47 in the end portion 34, while the clamping beam 29 has two complementary lateral recesses 48. When the new adhesive tape end 35 is seized by the clamping beam 29, the clamping beam 29 moves closely past the delivery block 16, so that the teeth 47 engage the lateral recesses 48. The new adhesive tape end 35 that adheres to the delivery block 16 also adheres to the teeth 47, so that said new adhesive tape end can be received by the clamping beam 29 in an operationally reliable manner thanks to the overlapping area. FIG. 14 shows the clamping beam 29 in the clamping position.

Figure 15:
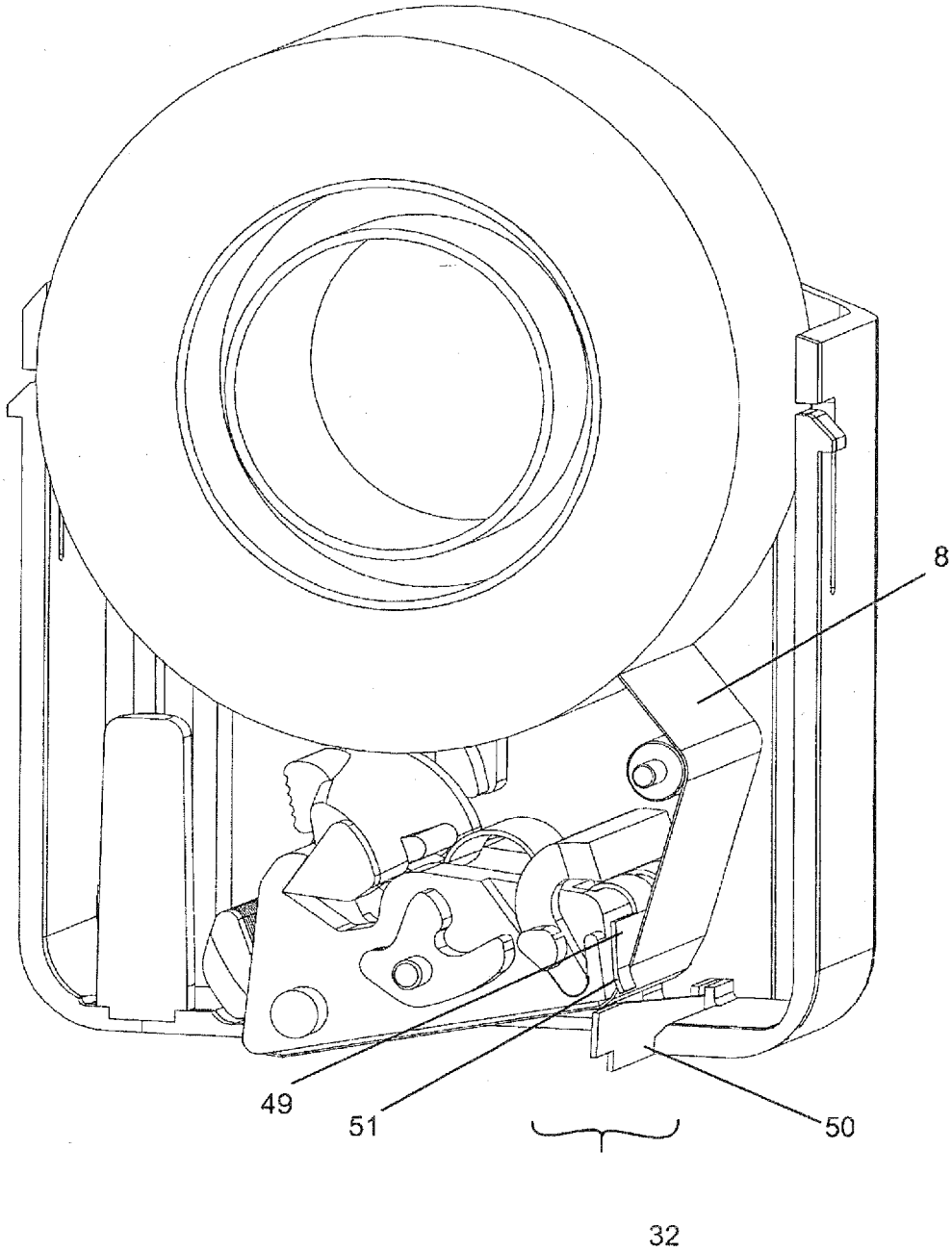
FIG. 15 shows a partially sectional view of the adhesive tape stamp of the previous figures in the position of pulling off the tape in order to illustrate the cutting process.

Referring to FIG. 15, the shear motion for severing the adhesive tape 8 will now be explained. The cutting device 32 comprises a first blade 49 which is attached to the plate body 9 and/or is moved along with said plate body, and a second blade 50 which is arranged in the lower housing part 5. The second blade 50 is arranged so as to be rigid; the first blade 49 is suspended so as to be elastic and, particularly preferred, is constructed in one piece with the spring element 43, as is apparent from FIGS. 11 and 12 for example. The first blade 49 comprises a seizing projection 51 which is bent away from the plate body 9 relative to the blade 49. If movement in the direction of movement 6 continues, the seizing projection 51 seizes the second blade 50. The first blade 49 is pushed away from the plate body 9 in an elastic manner due to said bending of the seizing projection 51, so that the second blade 50 is introduced between the plate body 9 and the first blade 49. In this way, the adhesive tape 8 is held almost perpendicular to the blades 49, 50. The first blade 49 and the second blade 50 are optionally arranged at a somewhat oblique angle to each other and/or the blades are bevelled to enable the adhesive tape 8 to be sheared. Seen in an abstract way, the adhesive tape 8 bridges a channel in the stamp surface 11 on the side of the plate body during severing, which channel extends transversely to the direction of the tape and is limited to the side by the first blade 49. During severing, the second blade 50 is introduced into this imaginary channel. This arrangement of the blades 49 and 50 reduces the risk that the adhesive tape 8 will be squeezed and hence will not be completely severed. The control of the cutting process results from the superposition of the swivelling and linear motions of the plate body 9 or during the residual linear stroke (cf. FIG. 19).

An incomplete downward movement during the pressing process in the direction of the arrow 6 down to the bottom dead centre must be dealt with in an adequate manner in order to make the device operationally reliable in the case of incorrect operation or to increase the resistance to disturbances. Optionally, the adhesive tape stamp 1 therefore comprises an anti-retraction feature which prevents an uncontrolled operating state if the pressing/placing process is terminated prematurely. The anti-retraction feature is designed in such a manner that an upward movement of the pusher 13 is only possible upon arrival at and/or in the area of the bottom dead centre/turning point. The anti-retraction feature prevents an upward spring-back movement before the bottom dead centre has been reached. It causes the pusher 13 to remain near the point of release, thus bringing movement to a standstill. In a preferred implementation, the anti-retraction feature comprises a two-way guideway with two transition and/or turning points. A guiding pin on the side of the swivel joint is designed as a resilient hook, in particular a catch. During downward movement, the hook passes along a rail provided with notches. At the bottom dead centre of the stroke, the hook exits/leaves said track and springs into a non-toothed guideway. As the pusher moves upwards, said hook passes along this guideway until it is in the proximity of the upper dead centre. At the upper dead centre, the hook is caused to exit by means of a suitable shape of the control curve and moved to the starting point of the downward guideway. In the position of rest, it is non-tensioned. The notches are oriented in such a manner that the hook is prevented from moving upward in the notched rail. In another potential embodiment, this principle can also be implemented by a reverse structure, that is to say the hook is arranged on the lower housing part 5 and the notched rail is arranged on the swivel joint pusher.

Figure 16:
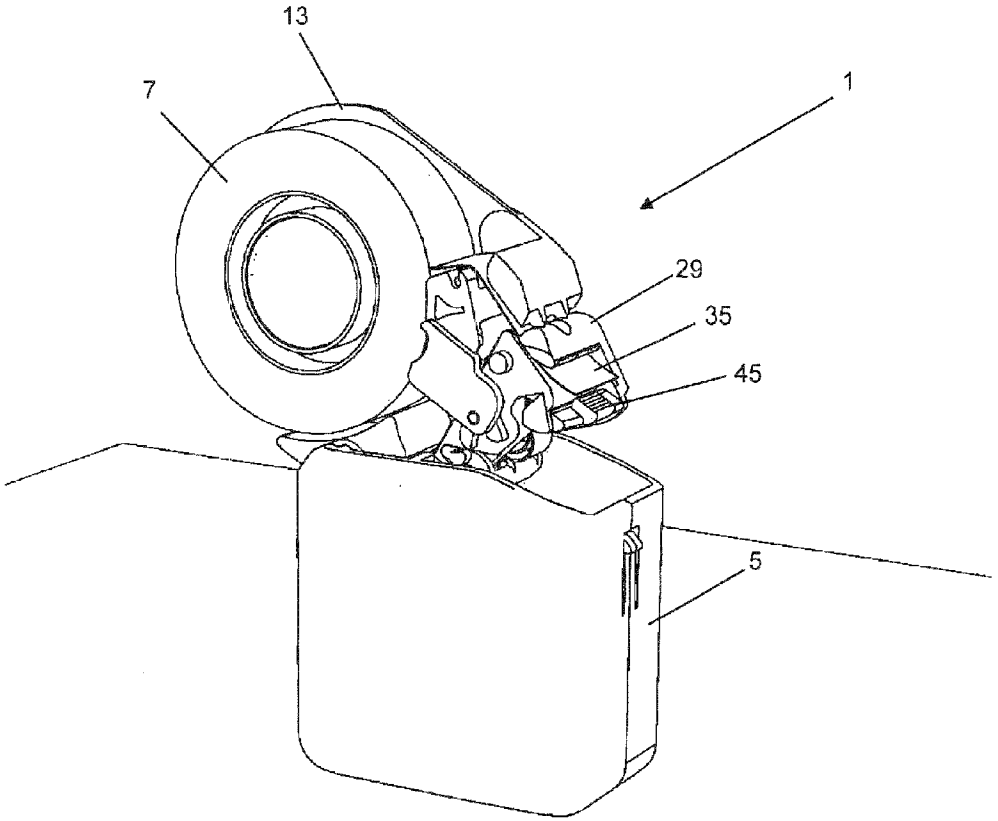
FIG. 16 shows the adhesive tape stamp of the previous figures during a replacement of the adhesive tape roll.

FIG. 16 finally illustrates the process of replacing the adhesive tape roll 7. For a replacement, the upper housing part 4 is first unlocked by actuating the unlocking elements 28 and is then completely slid off. In a next step, the pusher 13 is pushed out opposite to the direction of movement 6 by the spring force of the helical spring 25 until the pusher 13 can be swung out relative to the swivel joint body 20, for example by an angle of approx. 60° or ranging from 20° to 90°. In this state, the clamping beam 29 can be opened by actuating the actuating portion 45 and a new adhesive tape roil 7 can be inserted and the free adhesive tape end 35 can be positioned correctly. Once the clamping beam 29 has snapped into place, the pusher 13 can be swung back again and slid into the lower housing part 5. A cutting contour may optionally be arranged on the clamping beam 29 to enable the adhesive tape 8 to be cut, severed or torn off once the new adhesive tape roll 7 has been inserted. When the upper housing part 4 has been positioned and locked, the adhesive tape stamp 1 is ready for use again.

Figure 17:
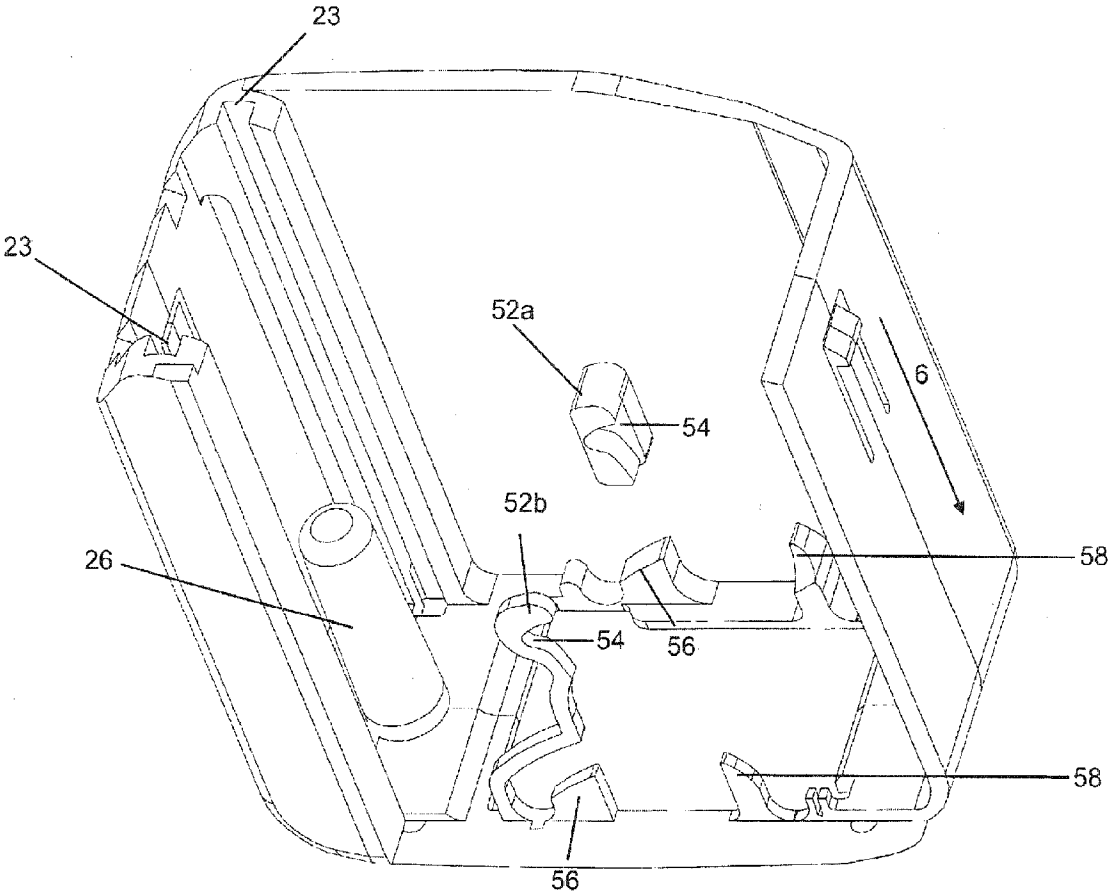
FIG. 17 shows the lower housing part of the adhesive tape stamp of the previous figures.

FIG. 17 shows a diagrammatic, three-dimensional view of the lower housing part 5 in the form of a partial section in order to illustrate the control elements for controlling the plate body 9 and the other movable components. In the illustration, the front wall has been suppressed in the drawing. FIG. 17 shows both the peg 26 which holds the helical spring 25 and the guideways 23. A main control element 52 is integrally moulded on the rear side of the lower housing part 5, approximately in the centre thereof, and interacts with a gear wheel segment 53 which is integrally moulded or arranged on the plate body 9 (FIGS. 9 and 10). The main control element 52*a* comprises a lateral, open guideway 54 which has an indentation followed by a ramp-like path in the direction of movement 6. The gear wheel segment 53 is designed to be asymmetrical in plan view and comprises a central main tooth 55 which engages the guideway 54. A plate cam control path 56 for controlling the plate cam 57 (FIGS. 9 and 10) is arranged in the bottom area of the lower housing part 5, the function of which will be explained below with reference to the following figures. To the side thereof, a further control path 58 for controlling the pressing member 34 is arranged, which interacts with the control cam 46.

A corresponding main control element 52*b* can be seen on the front side of the lower housing part 5; it is integrally moulded on the front wall which has been suppressed in the drawing and interacts with a second gear wheel segment 53 of the plate body 9. The front-side main control element 52*b* carries a longer guide mechanism than the rear-side main control element 52*a*, where the guideway 54 is followed by the plate cam control path 56.

Figure 18:
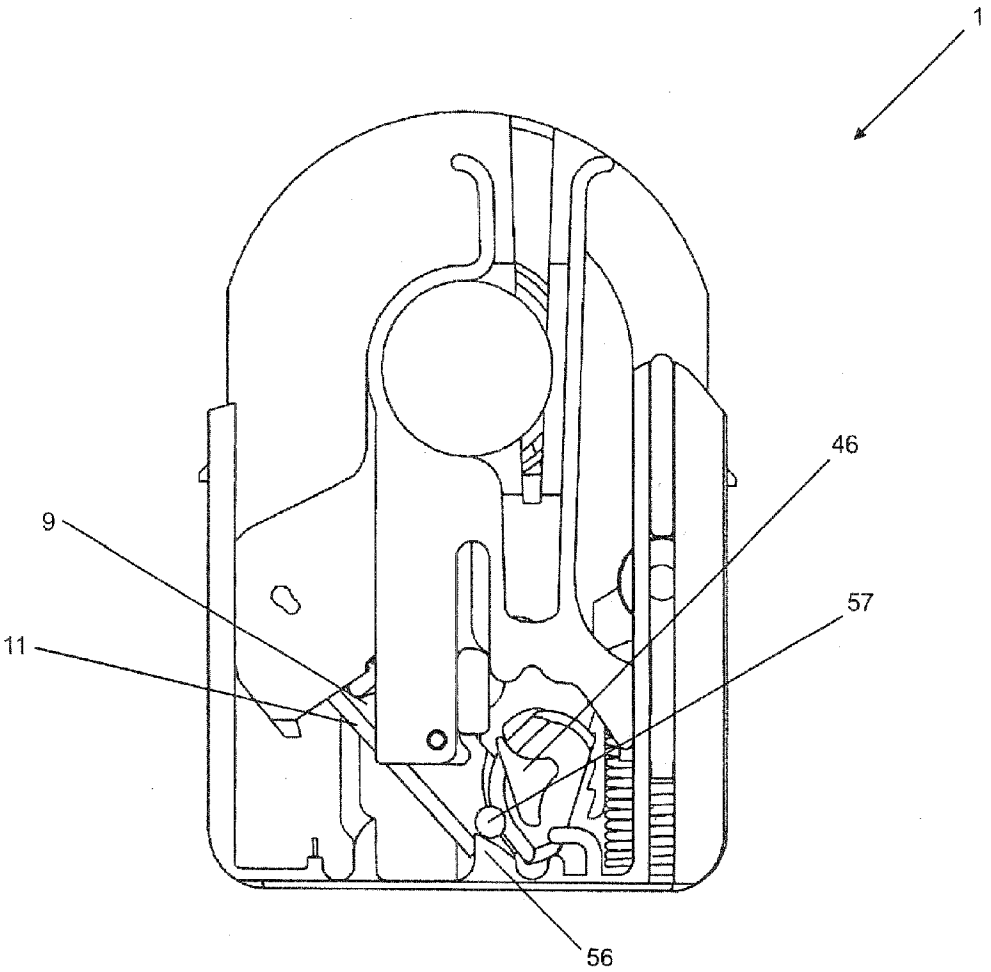
FIGS. 18-20 show the adhesive tape stamp of the previous figures in different positions before and during placement of the adhesive tape section.

FIG. 18 shows the adhesive tape stamp 1 with some components partially suppressed in a stage where the plate angle of the plate body 9, in particular of the stamp surface 11, is at an angle of approx. 45° to the underlying surface. In this stage, the plate cam 57 passes along the plate cam control path 56, wherein the control cam path is at an angle of approx. 40° to the underlying surface.

Figure 19:
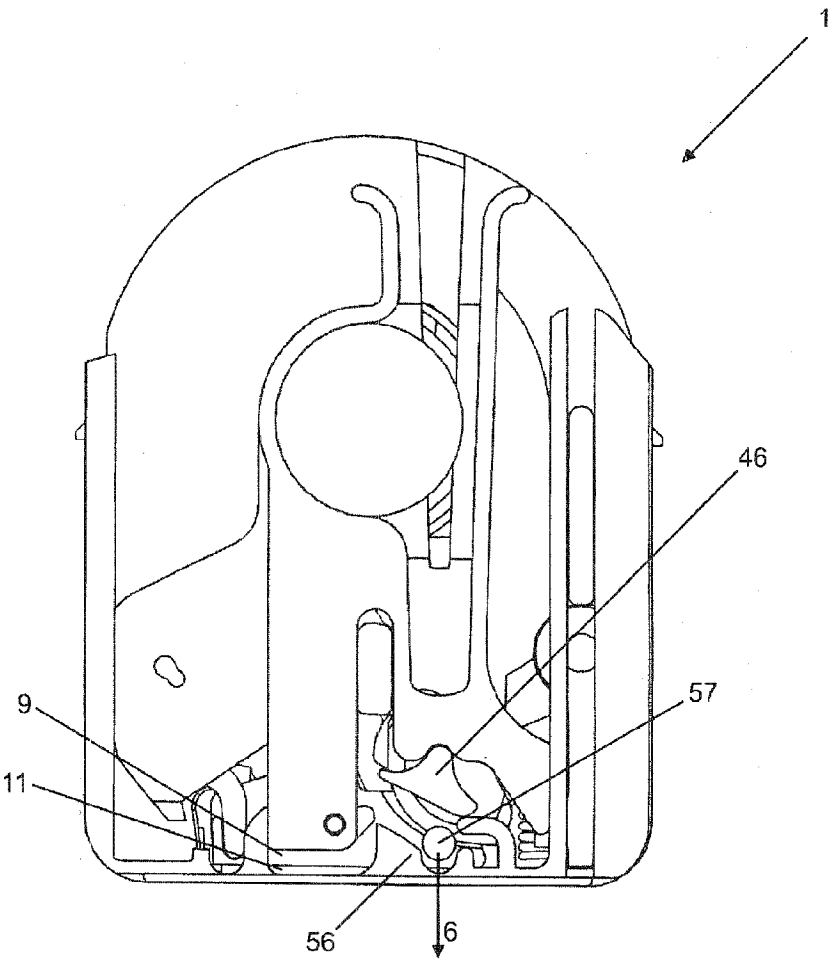

In FIG. 19, the plate cam 57 has reached an end of the plate cam control path 56, so that the plate cam 57 will now move parallel or almost parallel to the direction of movement 6 in the direction of the underlying surface. This embodiment is an example of a mechanical implementation which enables a linear lifting movement to be carried out during the last stage of placing the adhesive tape section 3 on the underlying surface. The stamp surface 11 is aligned parallel to the underlying surface here. This linear movement which is parallel to the direction of movement 6 enables the adhesive tape section 3 to be pressed uniformly against the underlying surface. During the aforesaid lifting movement, the clamping beam 29 has completely released the adhesive tape section or the free adhesive tape end 12.

Figure 20:
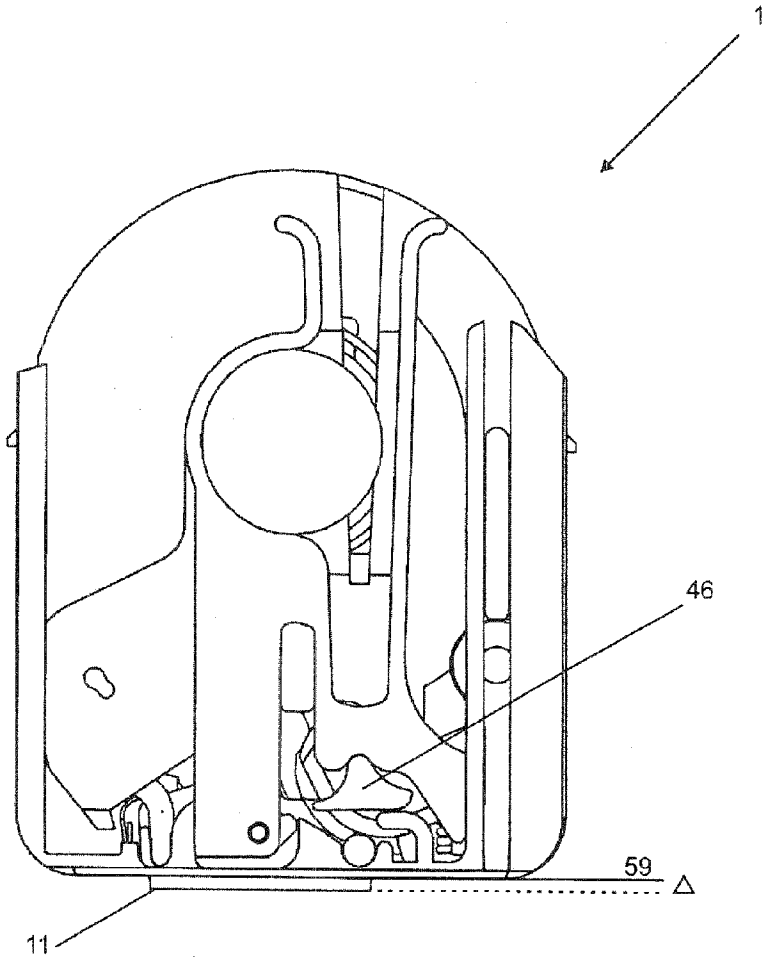

FIG. 20 finally shows the case where excessive pressure is applied to the adhesive tape stamp 1, wherein the stamp surface 11 would project beyond the contact surface 57 of the adhesive tape stamp 1 if there is no underlying surface. This configuration has the advantage that the adhesive tape section 3 can also be applied to an irregular underlying surface if the stamp surface 11 or the covering thereof is designed to be elastic, wherein the elasticity of the covering compensates for the irregularities in this example. There are, however, several options to chose from in order to achieve said projection: on the one hand, an elastic pressing surface on the side of the plate may be used. As an alternative or supplement, the mechanical components, in particular the control elements, may be dimensioned and designed to be elastic in such a manner that they allow excessive pressure to be applied. Another alternative or supplement consists in that feet or contact geometries for placing the adhesive tape stamp 1 on the underlying surface are designed to be elastic, so that they will yield if pressure is applied, thus enabling the aforesaid projection.

In addition, it is pointed out that at least one of the front sides of the clamping beam 29 comprises control elements for controlling the clamping beam. These are preferably affixed to the clamping arm 37. They interact with control elements in the lower housing part 5 and the pusher 13. Said control elements are designed with a suitable geometry and cause the clamp to open and close.

LIST OF REFERENCE NUMERALS

1 Adhesive tape stamp
2 Object
3 Adhesive tape section
4 Upper housing part
5 Lower housing part
6 Arrow/direction of movement
7 Adhesive tape roll
8 Adhesive tape
9 Plate body
10 Plate axis
11 Stamp surface
12 free adhesive tape end
13 Pusher
14 Roll holder
15 Tape deflection roller
16 Delivery block
17 Fluted surface
18 Holding contour
19 Swivel joint axis
20 Swivel joint body
21 Receptacles
22 Guiding rails
23 Guideways
24 Spring receptacle
25 Helical spring
26 Peg
27 Catch
28 Unlocking elements
29 Clamping beam
30 Front side
31 Plate edge
32 Cutting device
33 Opposite plate edge
34 Pressing member
35 Newly formed tape end
36 End portion
37 Clamping arm
38 Bearing portion
39 Bearing cup arrangement
40 Prism bearing
41 Prism end
42 Tips
43 Spring element
44 Actuating beam
45 Actuating portion
46 Control cam
47 Teeth
48 Lateral recesses
49 First blade
50 Second blade
51 Seizing projection
52 Main control element
53 Gear wheel segment
54 Guideway
55 Main tooth
56 Plate cam control path
57 Control cam
58 Further control path
59 Contact surface

The invention claimed is:

1. An adhesive tape application device for applying an adhesive tape section to an object, wherein the adhesive tape application device is designed for pulling an adhesive tape end from a supply of adhesive tape and applying said adhesive tape end to the object as an adhesive tape section by a relative motion of a movable portion and a stationary portion arranged on the object, comprising an application device, wherein the application device is designed and/or arranged for pressing the adhesive tape section against the object in an application position of the application device, wherein the application device is designed and/or arranged for performing a superimposed, rotational-linear and/or swivelling-linear movement in the adhesive tape application device, and wherein the application device is designed as a pressing: member for pressing and/or placing and/or transferring a free end of the adhesive tape against, on or to a pressing block.

2. An adhesive tape application device according to claim 1, wherein the pressing member is supported so as to be movable, and/or is connected so as to be elastic, in particular resilient, in the application device.

3. An adhesive tape application device according to claim 1, wherein the pressing member is moved by means of a control device in the stationary portion and/or wherein the pressing block is arranged in the movable portion.

4. An adhesive tape application device according to claim 1, wherein the application device comprises a clamping device which is designed for clamping the adhesive tape end.

5. An adhesive tape application device according to claim 4, wherein the clamping device comprises a clamping body which is supported so as to be swivellable in a bearing device and serves to clamp the adhesive tape end to the application device.

6. An adhesive tape application device according to claim 5, wherein the clamping body is designed as beam, wherein the adhesive tape end is arranged between the beam and the application device.

7. An adhesive tape application device according to claim 5, wherein the clamping body can have two stable and/or self-supporting positions in the bearing device and/or is designed as a prism bearing.

8. An adhesive tape application device according to claim 7, wherein the clamping device comprises an operating handle for manual switching between the two positions.

9. An adhesive tape application device according to claim 5, wherein the clamping device, and the pressing block comprise areas that engage one another at least at times, so that the adhesive tape end can be transferred from the pressing block to the clamping body.

10. An adhesive tape application device according to claim 9, wherein the clamping device, and the pressing block are designed and/or arranged so as to be complementary and/or to engage one another by means of teeth in some portions.

11. An adhesive tape application device according to claim 1, wherein the application device comprises a first cutting device and the stationary portion comprises a second cutting device, wherein the first and second cutting devices are designed for severing the adhesive tape section from the adhesive tape roll.

12. An adhesive tape application device according to claim 11, wherein the first and/or the second cutting device(s) is/are suspended so as to be resilient and/or elastic perpendicular to the direction of cutting and/or is/are designed for severing the adhesive tape by shearing.

13. An adhesive tape application device according to claim 11, wherein the second cutting device is offset relative to the first cutting device towards the centre of the application device in the cutting position.

14. An adhesive tape application device according to claim 1, wherein an anti-retraction feature is integrated between the stationary and the movable portions and prevents the movable portion from being retracted until the adhesive tape section has been applied to the object and/or until the application position has been passed.

15. An adhesive tape application device according to claim 1, wherein the application device is elastically pre-tensioned on the object in the application position in such a manner that the adhesive tape section is pressed onto the object and/or that the contact surface of the stationary portion on the object and/or an application surface of the application device and/or a kinematic chain between the contact surface and the application surface is/are designed to be flexible and/or elastic and that a flexible projection of the application surface relative to the contact surface is obtained in the application position, wherein the projection acts as an elastic pressing device.

* * * * *